United States Patent [19]

Marchesi

[11] Patent Number: 4,681,047

[45] Date of Patent: Jul. 21, 1987

[54] STRUCTURE OF AN UPPER HOOK PROVIDED WITH A HOLE AND USED IN SEWING MACHINES FOR MAKING OVEREDGE STITCHES

[75] Inventor: Franco Marchesi, Pavia, Italy

[73] Assignee: Rockwell-Rimoldi S.p.A., Italy

[21] Appl. No.: 708,837

[22] Filed: Mar. 6, 1985

[30] Foreign Application Priority Data

Jul. 31, 1984 [IT] Italy ..... 22763 B/84

[51] Int. Cl.[4] ..... D05B 57/06

[52] U.S. Cl. ..... 112/162; 112/270

[58] Field of Search ..... 112/162, 199, 201, 270, 112/197 (U.S. only)

[56] References Cited

U.S. PATENT DOCUMENTS

| | | | |
|---|---|---|---|
| 356,590 | 1/1887 | Kohler | 112/162 |
| 719,552 | 2/1903 | Arnold | 112/162 |
| 1,640,201 | 8/1927 | Maier | 112/199 X |
| 4,252,072 | 2/1981 | Draghicchio et al. | 112/199 |

FOREIGN PATENT DOCUMENTS

| | | | |
|---|---|---|---|
| 297486 | 9/1928 | United Kingdom | 112/162 |

*Primary Examiner*—Wm. Carter Reynolds

[57] ABSTRACT

An upper hook structure for use in conjunction with a lower hook and a needle to form overedge stitches, in which the hook has a hole, a tip curved in the direction of the lower hook and a shoulder formed in a middle position on the upper hook to stop and guide the thread of the lower hook.

5 Claims, 10 Drawing Figures

STRUCTURE OF AN UPPER HOOK PROVIDED WITH A HOLE AND USED IN SEWING MACHINES FOR MAKING OVEREDGE STITCHES

BACKGROUND OF THE INVENTION

The present invention relates to the structure of an upper hook provided with a hole and used in sewing machines for making overedge stitches, in particular sewing machines which are used in industry for making whipstitch No. 504 of the Federal Standard Catalog, on medium-lightweight fabrics.

As is known, sewing machines of the industrial type are able to form the so-called overedge stitch using three basic elements: a needle, an upper hook and a lower hook.

The needle and lower hook are always provided with thread, whereas the upper hook may or may not be provided with thread, depending on the type of stitch to be formed: in particular, it must be provided with thread in order to form the said overedge stitch No. 504 dealt with in the present invention.

The overedge stitch with three threads (that of the needle, that of the upper hook and that of the lower hook) is formed on the edges of a fabric and consists of various operating phases, known per se, in which the lower hook wedges itself between the needle and the needle thread, the upper hook wedges itself between the lower hook and the thread of the lower hook, and the needle wedges itself between the upper hook and the thread of the upper hook, obviously, before wedging itself between the said lower hook and the threads coming from the stitch previously formed. During these said operations, the degree of tensioning of the various threads is of vital importance not only for forming stitches with the threads themselves correctly arranged, as regards tensioning, but also so as to prevent irregularities and even the loss of stitches.

It has been shown in tests that thick and heavy fabrics make it easier, obviously within certain limits, to control and tension correctly the threads which form the stitches, since the fabrics themselves, on account of their greater thickness, firmly hold the threads and prevent any irregular tensioning of the latter, it not being possible to deform the said fabrics easily. On the other hand, very thin and lightweight fabrics can be easily deformed and, as a result, loose stitches can easily occur in the vicinity of tight and tensioned stitches, thus giving rise to undesired puckering of the fabric.

In practice, lightweight fabrics leave the threads substantially free and the latter are able to arrange themselves, in a random manner, in a large number of positions.

Another consequence of this situation is that it is practically impossible to form the overedge stitch using a very small pitch, since, in this case, the random fluctuations of the threads become too great and the danger arises of stitches being missed.

In fact, it is known that sewing machines of the industrial type which make overedge stitches with three threads on lightweight fabrics, operate with a maximum number of 38 stitches per inch.

Oscillations of the said threads occur in a particularly marked manner in the vicinity of the upper hook. In fact, the latter initially penetrates between the lower hook and associated thread, separating the latter, then causes the said thread of the lower hook to run along its blade, and finally brings its own thread into the vicinity of the tip of the needle. However, it may happen that either the upper hook engages with the thread of the lower hook in an imprecise manner or that the thread itself does not flow freely and is not guided properly along the blade of the upper hook, thus also running the risk of coming into contact with the support components of the said upper hook and becoming entangled with them or even of breaking. Also, the needle may fail to insert itself correctly between the upper hook and associated thread.

In view of the above, the general aim of the present invention is to design the structure of an upper hook provided with a hole so that it is able to remedy substantially the abovementioned drawbacks.

Within the context of this general aim, it is an important object of the present invention to design a said upper hook which is able to control efficiently the positions of the threads with which it engages, even in the case of operations involving lightweight fabrics.

Another important object of the present invention is to design an upper hook which has a simple structure and can be easily produced by the industries in the sector.

SUMMARY OF THE INVENTION

These and other objects, which will become clearer below, are achieved by the structure of an upper hook provided with a hole and used in sewing machines for making overedge stitches, in particular on medium-lightweight fabrics. The upper hook structure comprises a tip curved in the direction of the lower hook, and a projection adjoining the said curved tip and facing the stitches already formed, and wherein the blade of the said upper hook has a broken-line profile, in a substantially vertical plane, which defines a shoulder arranged substantially in a middle position on the blade of the said upper hook for stopping and guiding the thread of the lower hook.

Further characteristic features and advantages will become apparent from the description of a preferred embodiment of the invention, illustrated by way of example in the attached drawings in which:

FIG. 1 shows a perspective view of the components of a sewing machine of the industrial type, including the upper hook according to the present invention, FIG. 2 shows, in schematic form, the trajectory of the needle shown in FIG. 1, in relation to the upper hook and the lower hook, FIGS. 3 and 4 show, respectively, a plan view and a bottom view of the active end portions of the upper hook and lower hook shown in the preceding Figures, in the position where they are closest to each other, FIGS. 5, 6 and 7 show, respectively, an elevated view, side view and plan view of the upper hook provided with a hole, which is the subject of the present utility model, and, FIGS. 8, 9 and 10 show in perspective and in schematic form some of the stages during formation of an overedge stitch with three threads.

DESCRIPTION OF THE PREFERRED EMBODIMENT

Figures 1, 2:
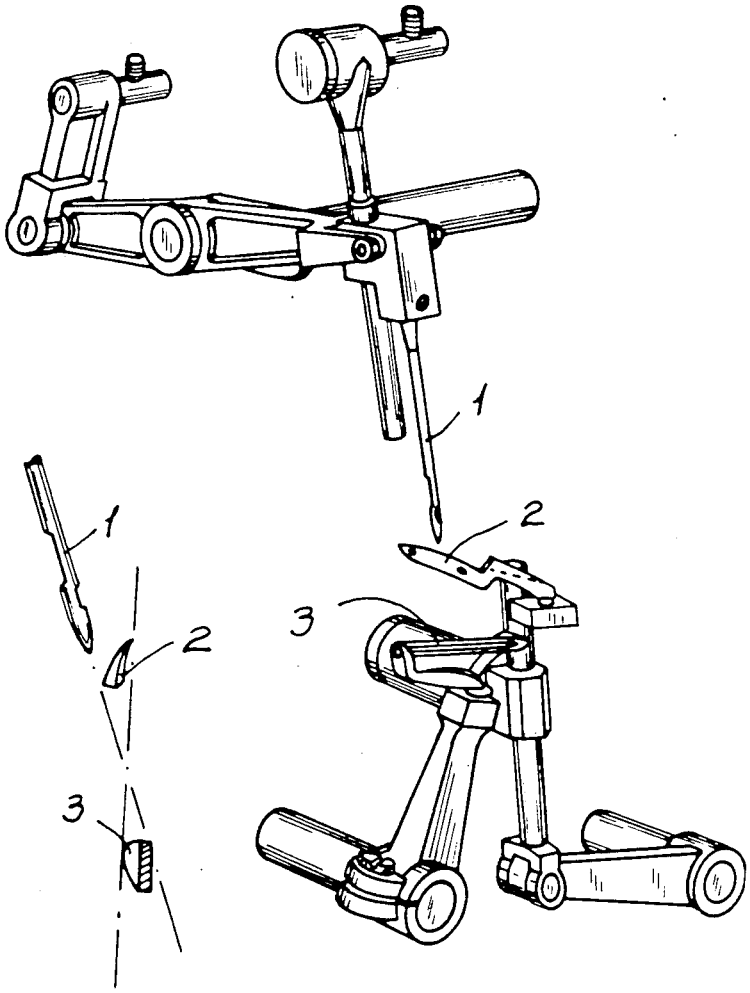

With reference to the abovementioned drawings, the sewing machine according to the invention, comprises in a manner known per se as shown in FIG. 1, a needle 1, and upper hook 2 and a lower hook 3, each of which is provided with thread and connected to respective actuating components. The needle 1 has a trajectory which is substantially tangential to the hooks 2 and 3 (FIG. 2).

Figure 7:
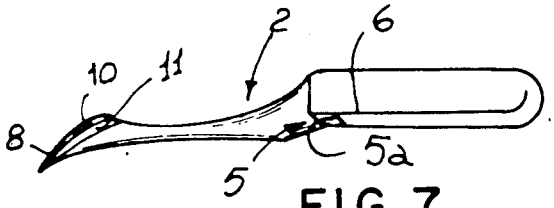
Figure 9:
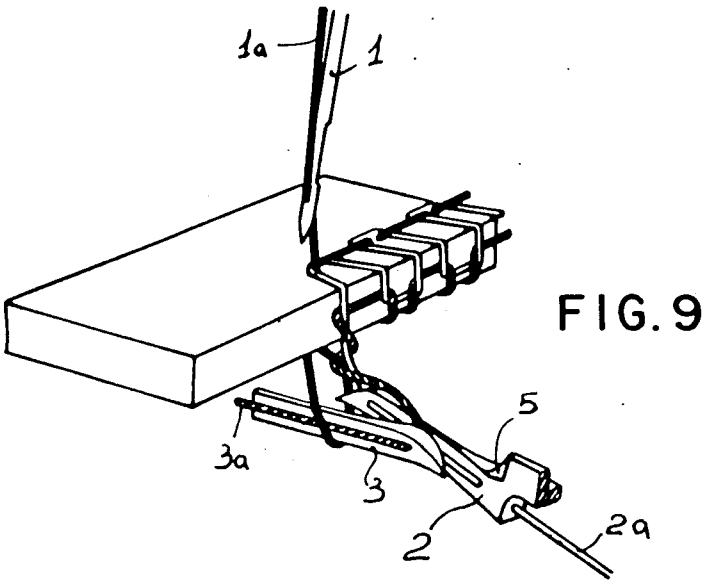
Figure 10:
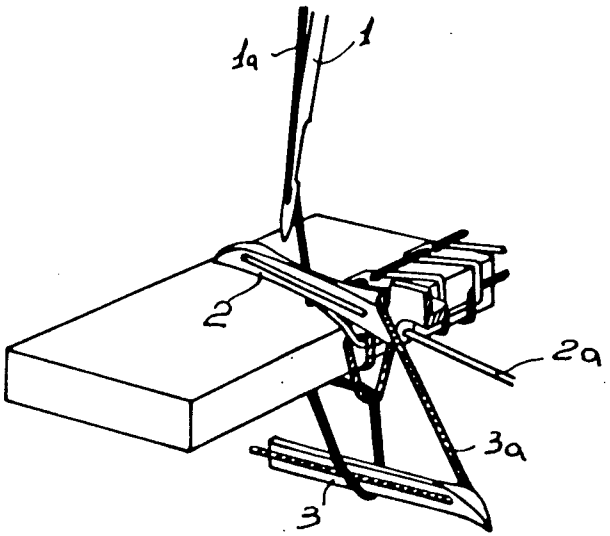
Figure 8:
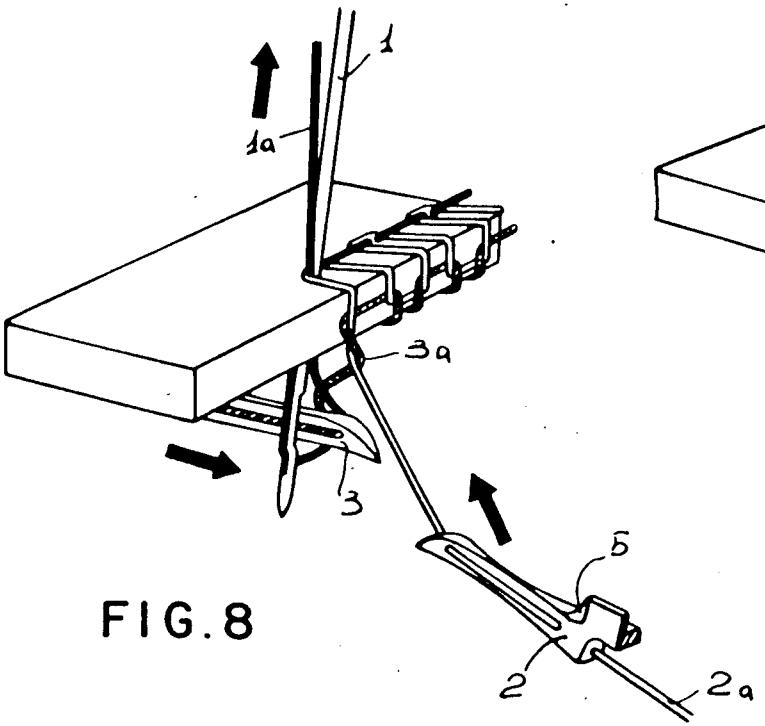

According to the invention, the upper hook 2 is provided with a hole for the pasage of an associated thread to 2*a* (see FIGS. 8 to 10 where the thread of the needle 1 and the thread of the lower hook 3 are indicated by 1*a* and 3*a*, respectively). Upper hook 2 has a special structure, as shown in FIGS. 3 to 7, which is suitable in particular for forming an overedge stitch with the threads on medium-lightweight fabrics.

Figure 5:
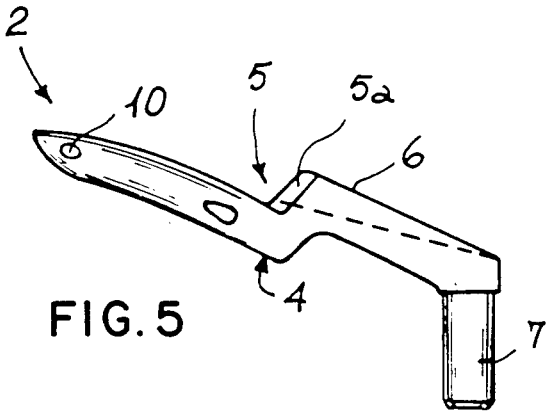
Figure 6:
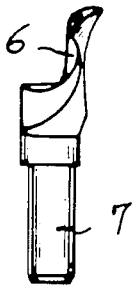

The upper hook 2 has, in fact, as is clearly visible from FIG. 5, a blade 4 provided with a broken-line profile, in a substantially vertical plane, which defines a shoulder 5 for stopping and guiding the thread 3*a*. The shoulder 5 is arranged substantially in a middle position on the blade 4 and is substantially defined by a rib 6 gradually diminishing in the direction of a shank 7 which forms the connection piece for the upper hook 2, which is located substantially vertically, as shown in FIG. 1.

The shoulder 5 for stopping and guiding the thread 2*a* (see FIG. 10) has a guiding surface 5*a* which is inclined relative to the main direction in which the upper hook 2 extends and which faces the lower hook 3. This guiding surface 5*a* enables the thread 3*a* to position itself properly and run freely, as is shown again by FIG. 10.

Figure 3:
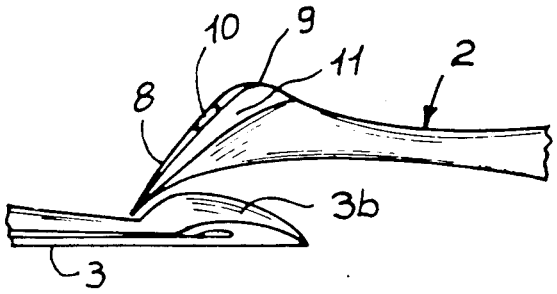
Figure 4:
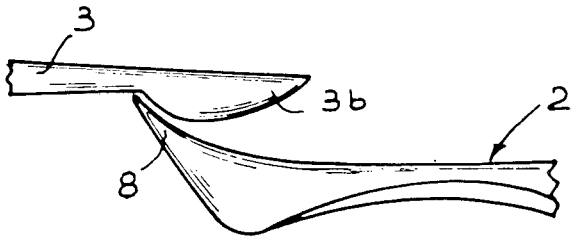

The upper hook 2 also has a tip 8 which is curved in the direction of the lower hook 3, as can be seen in FIGS. 3, 4, and 7. The lower hook 3 matches the shape of this curve tip 8 and is provided with bulge 3*b*.

Moreover, the upper hook 2 has a bulge 9 which lies immediately next to the curved tip 8 and faces the stitches already formed, on the opposite side to the lower hook 3. The hole 10 through which the thread 2*a* passes is located midway between the curved tip 8 and the projection 9.

Attention is also drawn to the fact that the upper hook 2 has a chamfered surface 11 extending in that area of the said upper hook which is occupied by the tip 8 and the projection 9. This chamfer 11 which is located on the upper edge of the bulge 9 in the upper hook 2 and which is oriented toward the apex of tip 8, at which point it becomes null, is inclined so as to taper the hook itself, on the side where the bulge 9 is located.

FIGS. 3 and 4, in particular, also show that the side surface of the upper hook 2 extending between the apex of the tip 8 and the bulge 9 is substantially parallel to the axis of the shank 7. It is in the region of this side surface that the hole 10 is provided for the passage of the thread 2*a*.

Operation of the sewing machine according to the invention, with reference in particular to the upper hook described above, is as follows: as FIGS. 3 and 9 show, during one of the operating phases of the sewing machine, the upper hook 2 passes in the vicinity of the lower hook 3 and engages with the thread 3*a* of the latter. On account of the curve tip 8, the upper hook 2 and the thread 3*a* engage precisely, and the thread itself, on account of the chamfer 11, is immediately conveyed in the direction of the blade 4. In fact, the upper looper or hook 2 during its upward stroke, inclines its rear part, that is the part of the shank 7, downwardly, so that the above mentioned chamfer 11 allows the thread 3*a* to pass from tip 8 onto blade 4 more easily and quickly. The thread 3*a* does not move to and fro freely on the blade 4, but is engaged by the stopping and guiding shoulder 5, which holds and controls the movement of the thread itself. The shoulder 5 allows the thread 3*a* to run freely, on account of the guiding surface 5*a*, but prevents the said thread from moving to and fro freely an each time creating different situations during formation and tensioning of the stitches.

When it reaches the top of its trajectory, the upper hook 2 presents its thread 2*a* to the needle 1. Owing to the presence of the projection 9 and owing to the shape of the end part of the said upper hook 2, which, as above described, is provided with a flat side surface extending between the apex of the tip 8 and the bulge 9, the looper itself acts in such a way that the thread 2*a* is spontaneously separated from the upper hook 2, thus allowing the needle 1 to be inserted easily.

It is also pointed out that the flattened shape of the surface of the upper hook 2 located in the vicinity of the hole 10, on the side where the projection 9 is located, facilitate phasing of the upper hook itself, by means of simple adjustments formed by rotating the said hook about the axis of the gudgeon pin 7.

The invention thus achieves the proposed objectives.

In particular, attention is drawn to the fact that, as a result of the improvements made, it is possible to achieve a substantial increase in the performance of sewing machines when the latter are working with lightweight fabrics. Practical tests have shown that, using upper hooks provided with structures in accordance with the present invention, it is possible to increase the maximum number of stitches per inch from 38 to 45–50.

All of the detailed features can be replaced by technically equivalent elements. In practice, the materials used can be of any type and the dimensions of any magnitude, as required.

I claim:

1. Structure of an upper hook provided with a hole and used in sewing machines having a needle and a lower hook for making whipstitches in particular on medium-lightweight fabrics, comprising a tip curved in the direction of the lower hook and a bulge adjoining the said curved tip and facing the stitches already formed, and wherein the blade of the said upper hook has a broken-line profile, in a substantially vertical plane, which defines a shoulder for stopping and guiding the thread of the lower hook, which shoulder is located substantially in a middle position on the blade of the said upper hook.

2. Structure as claimed in claim 1, wherein the said stopping and guiding shoulder comprises a guiding surface which is inclined relative to the main direction in which the said blade extends, the said guiding surface facing substantially the lower hook.

3. Structure as claimed in claim 1, wherein the said stopping and guiding shoulder is defined by a rib extending substantially in a parallel direction relative to the main direction in which the said blade extends.

4. Structure as claimed in claim 1, wherein the said upper hook comprises a chamfered surface, extending in the vicinity of the said tip and of the said projection, on its upper edge, the said chamfer being provided on the side where the said projection is located and extending so as to taper the said upper edge.

5. Structure as claimed in claim 1, wherein the surface lying between the said tip and the apex of said bulge is substantially flat, the said surface having a hole passing through it for the thread of the upper hook itself.

* * * * *